United States Patent [19]

Charron

[11] Patent Number: 4,770,161

[45] Date of Patent: Sep. 13, 1988

[54] GAS WATER HEATERS OR BATH HEATERS

[75] Inventor: Jean-Claude Charron, Saint Maur, France

[73] Assignee: Chaffoteaux & Maury, France

[21] Appl. No.: 22,815

[22] Filed: Mar. 6, 1987

[30] Foreign Application Priority Data

Mar. 6, 1986 [FR] France ..... 86 03189

[51] Int. Cl.[4] ..... F24H 1/00; F23H 1/00

[52] U.S. Cl. ..... 126/351; 122/448 R

[58] Field of Search ..... 126/350 R, 351; 122/447, 448 R, 448 A, 448 S; 236/23, 25 A; 251/30.02

[56] References Cited

U.S. PATENT DOCUMENTS

| | | | |
|---|---|---|---|
| 3,765,452 | 10/1973 | Charron | 251/30.02 |
| 3,815,813 | 6/1974 | Charron et al. | 236/23 |
| 4,267,820 | 5/1981 | Charron | 126/351 |
| 4,393,858 | 7/1983 | Mori et al. | 126/351 |
| 4,627,416 | 12/1986 | Ito et al. | 126/351 |

FOREIGN PATENT DOCUMENTS 1215731 11/1959 France .

*Primary Examiner*—Samuel Scott
*Assistant Examiner*—Noah Kamen
*Attorney, Agent, or Firm*—Larson and Taylor

[57] ABSTRACT

A water heater of the instantaneous gas type without a permanent pilot light includes: a small turbo-alternator through which the water drawn off passes; an arrangement for using the current from the turbo-alternator for lighting a main pilot light; a valve arrangement for using the flow of water drawn off to admit the gas to the main pilot light and a differential pneumatic valve for controlling the intake of gas to the burner. This differential pneumatic valve is itself actuated by a venting, at the level of an auxiliary pilot light, controlled by an electrovalve fed with the current i. The electrovalve is energized by the positive half waves of the current, chosen so that the cycles of its openings and closings can follow one another at a high rate and the durations of its openings are regulated by modifying the amplitude of the half waves by resistance responsive to the temperature of the drawn off water.

6 Claims, 2 Drawing Sheets

GAS WATER HEATERS OR BATH HEATERS

BACKGROUND OF THE INVENTION

The invention relates to instantaneous gas water heaters or bath heaters of the type without a permanent pilot light, operating without a battery and operating without connection to the electric mains. The invention including a small hydraulic turbo-alternator which is set in rotation by the water flowing through the water heater for the whole time during which hot water is drawn, which, in connection with a small electrovalve driving a differential membrane gas valve, provides automatically, whenever a tap is opened for drawing hot water, the following known and successive operations: lighting of the gas at the pilot light, checking the existence of a flame at the head of this pilot light, and then controlling the arrival of the gas at the burner.

Such an apparatus was described in the French Pat. No. 1 215 731 filed on the Nov. 7, 1958.

However, for several reasons it was not possible to make a commercially practical embodiment of that prior device. For example no solution was available up to the present time which was both sufficiently economical and sufficiently reliable for controlling the electrovalve from the current produced by the turbo-alternator, so as to provide thermostatic regulation of the water drawn off by making the gas flow rate automatically dependent on the temperature of the water drawn off.

SUMMARY OF THE INVENTION

The purpose of the invention is especially to provide such a solution.

To achieve this purpose, apparatus of the kind in question according to the invention again includes, in a way known per se, a small turbo-alternator through which flows the water drawn off and capable of generating an AC current i as a function of this through flow, means for using this current i for lighting a main pilot light, means for using the flow of water drawn off so as to admit the gas on the one hand to the main pilot light and, on the other, to a gas intake chamber, a pneumatic valve for controlling the arrival of the gas at the burner, the valving membrane of which valve divides the gas intake chamber sealingly into two compartments, opening of this valve being controlled by partial venting, at the level of an auxiliary pilot light, of one of the two compartments of this chamber, an electrovalve for causing this venting and means for using the current i for supplying the electrovalve with electricity so as to control the opening of this electrovalve solely when the main pilot light is lit. In this environment, the invention is characterized in that the electrovalve is chosen of a type such that the cycles of its openings and closings can follow one another at a relatively high frequency, of the order of a few tens of Hz, and that its openings are made dependent on the amplitude of its supply current overshooting a given threshold $I_n$ and in that the means controlling this electrovalve include means for adjusting at each instant the amplitude of the successive sinusoidal half waves of the current i before applying them to the electrovalve, this adjustment being effected as a function of the difference D between a reference value T of the temperature and the real temperature of the water drawn off at said instant so that the opening durations of the electrovalve, and so that of the valving membrane, vary in the same direction as this difference D.

In preferred embodiments, recourse is further had to one and/or the other of the following arrangements:

the adjustment means include a resistance responsive to the temperature of the water drawn off, which resistance is of a positive temperature coefficient type (PCT) for which the ohmic value increases rapidly as soon as the temperature reaches and exceeds the reference value T, the water heater includes means for rectifying the sinusoidal half waves of the current i before applying them to the electrovalve, these means being preferably formed by a diode bridge, the water heater includes means for amplifying the successive sinusoidal half waves of the current i before applying them to the electrovalve, the electrovalve is of the "inverter" type, adapted for causing the compartment which it controls to communicate alternately with the gas intake or with the atmosphere, and the section of the controlled nozzle which communicates with the atmosphere is greater than the section of the other nozzle.

The invention includes, apart from these main arrangements, certain other arrangements which are used preferably at the same time and which will be more explicitly discussed hereafter.

BRIEF DESCRIPTION OF THE DRAWINGS

A preferred embodiment of the invention will be described below with reference to the accompanying drawings in a way which is of course in no wise limitative.

BRIEF DESCRIPTION OF THE DRAWINGS

Figure 1:
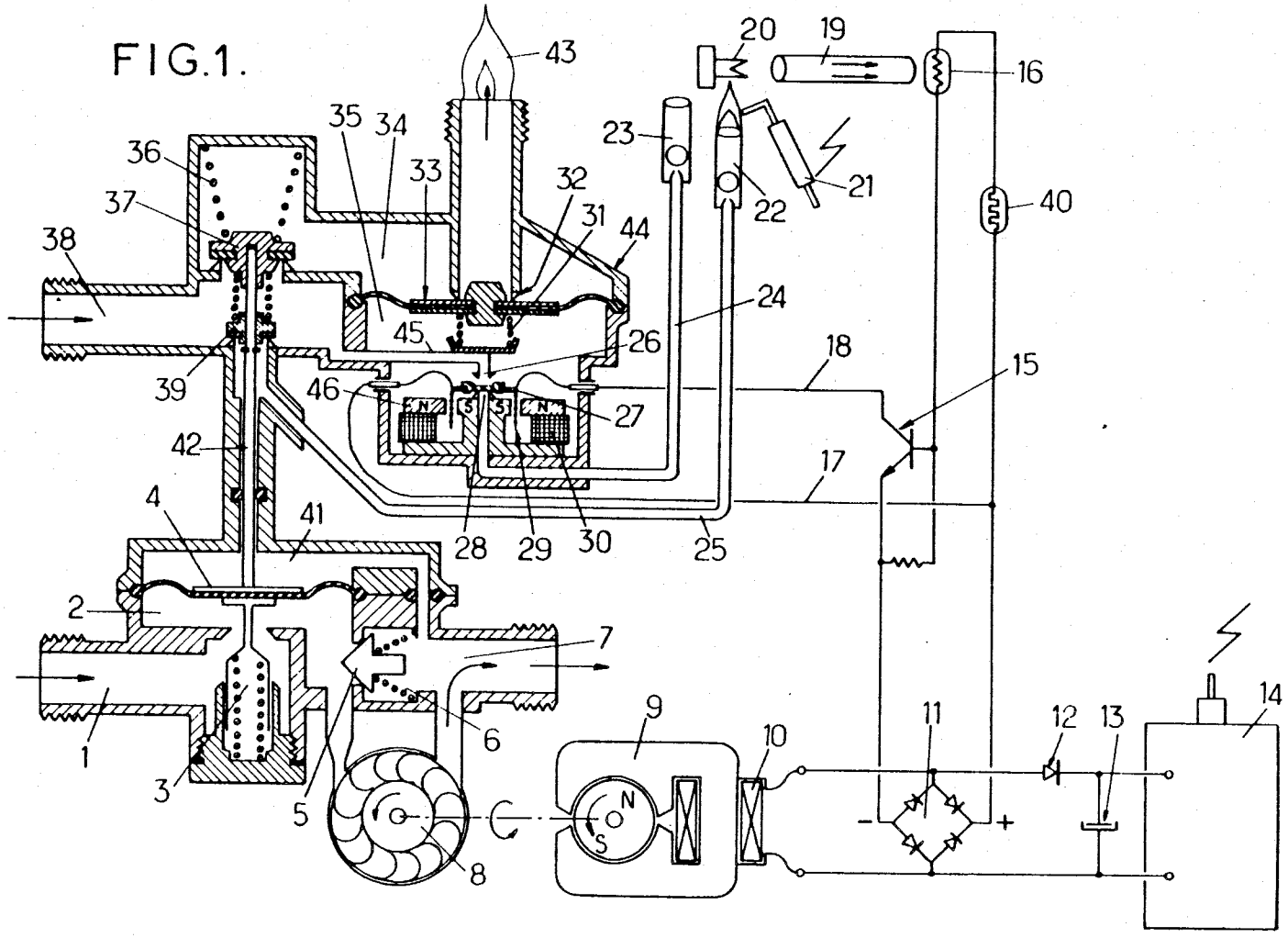
FIG. 1 shows very schematically an instantaneous gas water heater constructed in accordance with the invention.

At section 1 of a cold water pipe equipped with a water flow limiting valve 3 is shown just upstream from a chamber 2 defined by a differential membrane 4 of the "water deficiency safety valve" type loaded by a spring 36.

Downstream of chamber 2, the water is fed in parallel to an outlet relief valve 5 adjusted to a certain pressure by a spring 6 and to the turbine 8 of a small turbo-alternator 9, 10 these two channels being connected to the same outlet 7.

This outlet 7 is placed in communication with a second chamber 41 defined by the differential membrane 4 and it communicates successively with a water duct which passes through the heating housing (not shown), which dust is itself extended by the hot water draw-off pipe controlled by a tap (not shown).

Turbine 8 is chosen so that the drop in pressure of the water which flows through it is equal to the pressure difference applied to membrane 4 when the flow rate of this water is at its minimum value allowing the apparatus to operate.

This pressure difference is slightly less than that which causes initial opening of valve 5.

A duct 38 is provided for the intake of fuel gas to the burner 43.

This intake to burner 43 is controlled successively by a gas valve 37 mounted on a rod 42 connected to the center of membrane 4, and then by a differential pneumatic valve 44.

A second gas valve 39, also mounted on rod 42, controls the intake of gas to a main pilot light 22 through a duct 25.

The differential pneumatic valve 44 includes a gas chamber divided into two compartments, an upper one 34 and a lower one 35, by means of a membrane 33 whose valving central portion is applied by a spring 31 against a seat 32 integral with the burner 43.

Compartment 34 communicates with the downstream zone of valve 37.

Compartment 35 communicates either with the zone upstream of 37 through a tube 45, or with the atmosphere through a tube 24 ending in an auxiliary pilot light 23, depending on whether an "inverter" packing 27, situated in chamber 35, is applied against an outlet nozzle 26 of tube 45 or against an inlet nozzle 28 of tube 24.

This packing 27 is formed by the central portion of a vibrating membrane with very low inertia and substantially instantaneous response, as is well known in the loud speaker field.

This packing 27 secured to a very light mobile coil 29 adapted for moving in the air gap of an electromagnet 46. The frequency of the vibrations of the movable assembly is of the order of a few tens of Hz, being more generally comprised between 15 and 100 Hz, and the electric power necessary for creating said vibrations is very low, being generally lower than 80 mW (with a current intensity generally comprised between 50 and 100 mA).

The electric winding of the electromagnet 46 is connected to the stator winding 10 of the turbo-alternator 8-10 by means of an electronic circuit including a diode bridge 11, a photoresistance 16 responsive to the lighting of the pilot light 22, a temperature sensor 40 responsive to the temperature of the water drawn off, a transistor or other amplification means 15 and electric connection wires 17 and 18.

The stator winding 10 is also connected, through a rectifying (diode 12) and smoothing (capacitor 13) circuit to a high voltage recurrent spark ingnitor adapted for lighting the pilot light 22.

A black body 20 disposed in the vicinity of the top of the blue cone of the flame of this pilot light 22 and formed more particularly by a single very fine platinum wire, is brought, as soon as this pilot light is lit, to a temperature corresponding to a yellow radiation corresponding to the maximum spectral sensitivity of the photoresistance 16, for example of cadmium sulfide type.

A small light guide 19, formed more particularly by a simple glass rod, is provided for transmitting to the photoresistance 16 the radiation emitted by the samll black body 20.

The operation of the apparatus thus described is as follows.

As long as the flow of water drawn off after the opening of a tap remains less than a given threshold, this water flows through turbine 8 at a speed insufficient to cause anything to happen, and the different valves of the apparatus all remaining closed.

As soon as the flow of drawn water exceeds the minimum threshold provided for operation of the apparatus, the following set of consequences occur.

The water valve 5 opens gradually, while bypassing the turbine 8.

The gas valve 37 and 39 also open, which supply gas, to compartment 35, compartment 34 and the main pilot light 22.

The turbo-alternator generates electric current, which results in energizing the electrode 21 of igniter 14 and lighting the main pilot light 22.

The transmission of the bright light of the black body 20, through guide 19, to the photoresistance 16 results in causing the ohmic value of this latter to drop by a considerable proportion, substantially of the order of 100 to 1; the amplitude of the current which appears at the base of transistor 15 during the production of each current half wave rectified by the diode bridge 11, increases in the same proportion and is present at the collector of said transistor in a ratio further amplified by the gain of this transistor.

The purpose of this diode bridge 11 is to rectify one of the two half waves of each full wave of the AC current i generated by the stator winding 10 and to let the other half wave pass unmodified, and the half waves obtained, all of the same polarity (assumed positive in the present description) are applied to the mobile coil 29 one of the connection wires 18 of which is connected to the collector of the transistor 15, its other connection wire 17 being connected to the positive output of the diode bridge 11; the base of the transistor 15 is also connected to the positive output of this same bridge 11 in series with the photoresistance cell 16 and with the temperature sensor 40.

This latter is formed preferably by a positive temperature coefficient resistance, called PCT, having the known characteristic of undergoing, from a certain temperature, a very rapid and very considerable increase in its ohmic value.

Whenever, during the passage of a positive current half wave through the mobile coil 29, the instantaneous value of this current exceeds a certain threshold value In (see FIGS. 2 and 5) from which said mobile coil rises, the packing 27 which is integral with this coil is applied, by its upper face, against the small nozzle 26 which is closes, whereas its lower face moves away from the small nozzle 28 which it closed at rest, thus putting the chamber 35 situated under the membrane 33 in communication with the atmosphere through pipe 24 and the second pilot light 23 which is only provided for burning the small volume of gas escaping at that time from chamber 35.

It will be readily understood that at each passage of a current half wave, during the lapse of time during which the current in the mobile coil 29 exceeds the threshold In which causes said coil to rise, the gas leak which results therefrom at the pilot light 23 causes a progressive drop in the pressure of the gas in chamber 35, that is to say under the membrane 33, and since the pressure in chamber 34 above this same membrane is constant and substantially equal to the gas supply pressure of the apparatus, the gas pressure differential on each side of the membrane increases and this increase is substantially proportional to the ratio between the duration A, of each half wave, during which the current in the mobile coil exceeds the threshold value In, and the total duration B of each half wave, that is to say to the rate of modulation of the width of the operating square waves of the electrovalve 30.

As can be seen in FIGS. 2 to 5, this modulation rate, which is expressed by the ratio A/B, itself increases as a function of the amplitude of the current half waves from the moment when the value of this amplitude exceeds the threshold current value In.

Since this amplitude is furthermore related, apart from the current gain of transistor 15, to the value of the current in the base of this same transistor and since this latter is related, through Ohm's law, to the ohmic value of the resistive sensor 40, it will be readily understood that whenever the temperature of the hot water produced approaches the temperature T from which the ohmic value of sensor 40 increases very rapidly, the base current of the transistor also decreases very rapidly, causing the same rapid decrease of the amplitude of the half waves in the mobile coil and, consequently, a decrease just as rapidly of the rate of modulation of the micro-electro valve, which causes a decrese in the differential pressure acting on membrane 33, which finally rises towards seat 32, thus reducing the flow of the gas to the burner 43.

This value T is given the reference value of the temperature at which it is desired to draw water.

In the opposite case, when the temperature of the hot water produced drops, the above described order of operating sequences is reversed.

Figure 6:
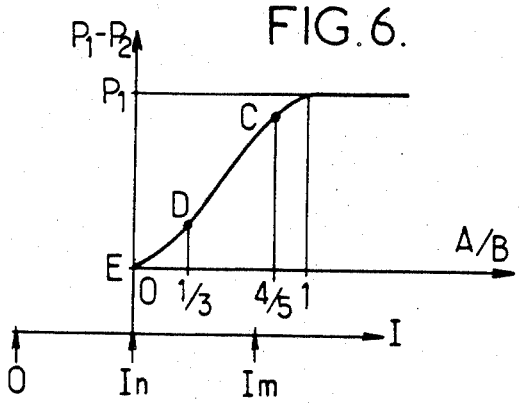
FIGS. 6 and 7 show two explanatory curves.

The curve of FIG. 6 shows the variations of the differential pressure P1-P2 applied to membrane 33 (P1 being the pressure of the gas in the upper compartment 34 and P2 the pressure of the gas in the lower compartment 35) as a function of the ratio A/B between the duration of opening A of the electrovalve 30 and the duration B of each current half wave.

On a second abscissa are plotted the corresponding values of the amplitudes of the current half waves applied to the electrovalve.

The point C of the curve corresponding to the maximum amplitude Im is the one beyond which a new increase of the amplitude, causing a new increase of the differential pressure P1-P2, has no effect on the gas flow rate, this latter having then reached its maximum value corresponding to the maximum rise of the differential membrane.

The value of the ratio A/B corresponding to this point C is here equal to 4/5.

Figure 2:
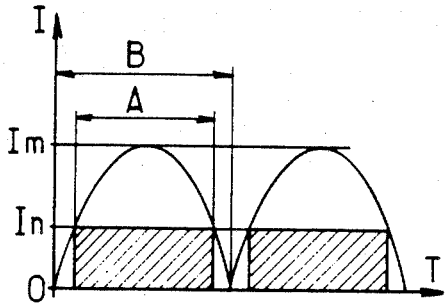
FIGS. 2 to 5 show respectively four pairs of rectified half waves of the current i, having decreasing amplitudes.
Figure 4:
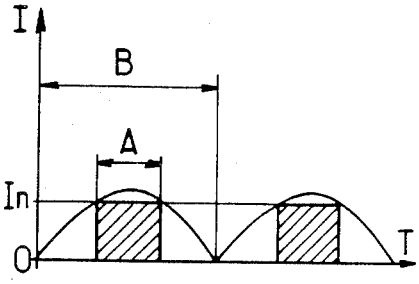
Figure 3:
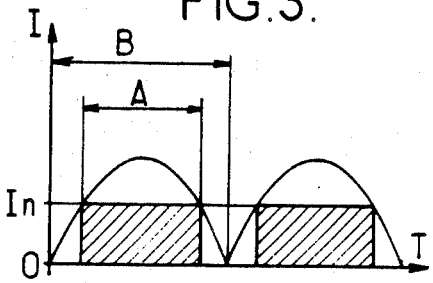
Figure 5:
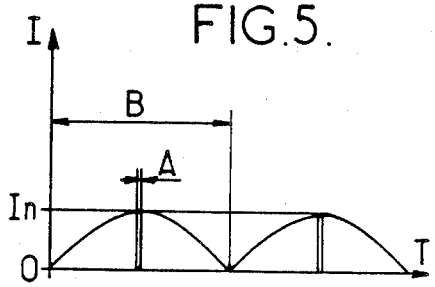

The point C in question corresponds to the situation shown schematically in FIG. 2 whereas point D (for which the ratio A/B is equal to $\frac{1}{3}$) corresponds to the situation shown schematically in FIG. 4 and point E (for which the ratio A/B is zero) corresponds to the situation shown schematically in FIG. 5.

This curve shows that, for the whole range of amplitudes between the threshold value In and the maximum value Im, the differential pressure P1-P2 is substantially proportional to the ratio A/B.

Figure 7:
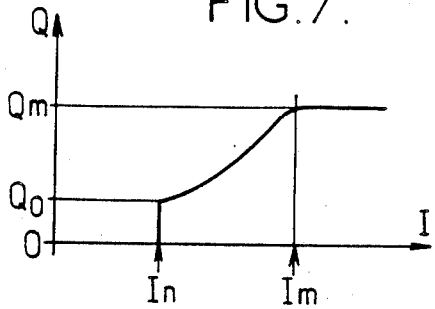

The same thing is substantially true for the flow rate of gas to the burner, as shown by the curve of FIG. 7: on this curve, this gas flow rate Q has been plotted as ordinates and the amplitude I of the current half waves applied to the electrovalve as abscissa.

The simple regulation of the above described amplitudes I as a function of the temperature of the water drawn off causes then that of the gas flow through the regulation of the relative width A/B of the current "square waves" or of the "modulation rate" of this current: the heating power generated by the burner is therefore higher the lower the temperature of the water drawn off.

This regulation is extremely simple, reliable and economical.

It should be noted that, to a certain extent, the heating power is also regulated as a function of the flow rate of the water drawn off since the amplitudes of the full waves of the current i generated by the turbo-alternator are substantially proportional to this flow rate, at least as long as the bypass valve 5 is not wide open.

It will be evident that the invention is in no way limited to those modes of application and embodiments which have been more especially considered, rather it embraces all variants thereof, particularly:

those in which the diode bridge 11 is replaced by a single diode, which would be tantamount to purely and simply suppressing one of the two half waves of each full wave of the current i, namely the negative half wave in the above described example, those in which the diode bridge is purely and simply omitted, only the half waves of useful polarity of the current i then being used for energizing the electrovalve (this construction, however reduces the extent of the possible adjustment range for the modulation rate, but it is particularly economical and avoids the slight voltage drop which can be observed when any rectifier has a current passing therethrough), those in which the current amplifying member is other than a transistor, this member being for example formed by an operational amplifier, those in which the electrovalve 30 is not "inverting" but is instead single acting and solely adapted for controlling the venting of compartment 35, and those in which said electrovalve is again "inverting", but in which the two nozzles 26 and 28 controlled thereby have different sections, in particular to increase the possible adjustment range of the above modulation rate when only one of the two half waves of each half wave of the current i is used, in which case it is the section of nozzle 28 which is the largest.

I claim:

1. An instantaneous gas water heater of the type without permanent pilot light, including a small turboalternator (8-10) through which the water drawn off flows and which comprises a means for generating an AC current i as a function of this through flow, means (12-14) for using this current i for lighting a main pilot light (22), means (4) for using the flow of water drawn off so as to admit gas, on the one had, to the main pilot light and, on the other hand, to a gas intake chamber, a pneumatic valve means (31-35) for controlling the intake of gas to the burner, the pneumatic valve means having a valve membrane (33) which divides the gas intake chamber of the pneumatic valve means sealingly into two compartments (35 and 35), means for controlling the opening of said pneumatic valve means by partial venting to an auxiliary pilot light (23), of one of the two compartments (35) of the chamber, said controlling means including an electrovalve (30) and means for using the current i for supplying the electrovalve with electricity so as to control the opening of this electrovalve only when the main pilot is lit, characterized in that the electrovalve (30) is of a type such that the cycles of its openings and closings can follow one another at a relatively high frequency, on the order of a few tens of $H_z$, in that its openings are made dependent on the overshoot of a given threshold $I_n$ by the amplitude of its supply current and in that the means for controlling this electrovalve include means (40) for adjusting at each instant the amplitude of the successive sinusoidal half waves of the current i before applying them to the electrovalve to adjust the duration of each cycle for which the said electrovalve is opened, this adjustment being effected as a function of the difference D between a reference value T of the temperature and the real temperature of the water drawn off at said instant so that the opening durations of the electrovalve and so also that of the valve membrane (33), vary in the same direction as this difference D.

2. Water heater according to claim 1, characterized in that the adjustment means include a resistance (40) sensitive to the temperature of the water drawn off, which resistance is of the positive temperature coefficient type (PCT) for which the ohmic value increases rapidly as soon as the temperature reaches and exceeds the reference value T.

3. Water heater according to claim 1, characterized in that it comprises means (11) for rectifying the sinusoidal full waves of the current i before applying them to the electrovalve (30).

4. Water heater according to claim 3, characterized in that the rectifying means are formed by a diode bridge (11).

5. Water heater according to claim 1, characterized in that it includes means (15) for amplifying the successive sinusoidal half waves of the current i before applying them to the electrovalve (30).

6. Water heater according to claim 1, characterized in that the electrovalve (30) is of the "inverting" type, adapted to cause the compartment (35) which it controls to communicate alternatively with the gas intake (45) or with the stmosphere (23,24) and in that the section of the controlled nozzle (28) which communicates with the atmosphere is larger than the section of the other nozzle (26).

* * * * *